US010267306B2

(12) United States Patent
McLoughlin

(10) Patent No.: US 10,267,306 B2
(45) Date of Patent: Apr. 23, 2019

(54) INTAKE PRESSURE CONTROL SYSTEM

(71) Applicant: John E. McLoughlin, Hauppauge, NY (US)

(72) Inventor: John E. McLoughlin, Hauppauge, NY (US)

( * ) Notice: Subject to any disclaimer, the term of this patent is extended or adjusted under 35 U.S.C. 154(b) by 0 days.

(21) Appl. No.: 16/052,295

(22) Filed: Aug. 1, 2018

(65) Prior Publication Data

US 2018/0347558 A1 Dec. 6, 2018

Related U.S. Application Data

(63) Continuation-in-part of application No. 16/030,634, filed on Jul. 9, 2018, which is a continuation of application No. 15/433,734, filed on Feb. 15, 2017, now Pat. No. 10,018,195.

(51) Int. Cl.

| | |
|---|---|
| ***F04B 49/06*** | (2006.01) |
| ***A62C 31/00*** | (2006.01) |
| ***F04B 49/24*** | (2006.01) |
| ***F04B 49/20*** | (2006.01) |

(Continued)

(52) U.S. Cl.

CPC ..... *F04B 49/06* (2013.01); *A62C 31/00* (2013.01); *F04B 17/05* (2013.01); *F04B 49/08* (2013.01); *F04B 49/20* (2013.01); *F04B 49/24* (2013.01); *F04B 2203/0605* (2013.01);

(Continued)

(58) Field of Classification Search

CPC ..... F04B 49/06; F04B 17/05; F04B 49/08; F04B 49/20; F04B 49/24; F04B 2205/151; F04B 2203/0605; F04B 2205/01; F04B 2205/02; F04B 2205/04; F04B 2205/05; A62C 31/00; Y10T 137/7758; Y10T 137/7759; Y10T 137/776; F16K 3/0209; F16K 3/32; F16K 3/33; F16K 3/34

See application file for complete search history.

(56) References Cited

U.S. PATENT DOCUMENTS 3,776,249 A * 12/1973 Wailes ..... F17D 5/06 137/14
2005/0061373 A1* 3/2005 McLaughlin ..... G05D 16/2053 137/565.13

(Continued)

*Primary Examiner* — Peter J Bertheaud
*Assistant Examiner* — Dnyanesh G Kasture
(74) *Attorney, Agent, or Firm* — Louise S. Heim

(57) ABSTRACT

A pump intake pressure control apparatus includes an intake conduit joining a pump to either a pressurized or unpressurized liquid source, a wide-range flow controller configured to control the flow of liquid through the intake conduit, pressure sensors for detecting the pressure of the liquid in the intake conduit upstream and downstream of the flow controller, and an electronic master controller programmed to receive input from the pressure sensors and to actuate the wide-range flow controller to maintain the pressure downstream of the wide-range flow controller at or below a predetermined desired value. In one embodiment of the invention, the wide-range flow controller is a branched portion of the intake conduit having a valve in each branch. In another embodiment of the invention, the flow controller is a gate valve having a stationary triangular blocking member projecting into the passage between the inlet and outlet ports of the valve.

14 Claims, 4 Drawing Sheets

(51) Int. Cl.
*F04B 49/08* (2006.01)
*F04B 17/05* (2006.01)

(52) U.S. Cl.
CPC ..... *F04B 2205/02* (2013.01); *F04B 2205/04* (2013.01); *F04B 2205/151* (2013.01)

(56) References Cited

U.S. PATENT DOCUMENTS

2013/0105010 A1* 5/2013 McLoughlin ..... F17D 3/00 137/557
2014/0345700 A1* 11/2014 Surawski ..... G05D 9/00 137/12
2016/0076334 A1* 3/2016 Maher ..... E21B 34/04 137/12

* cited by examiner

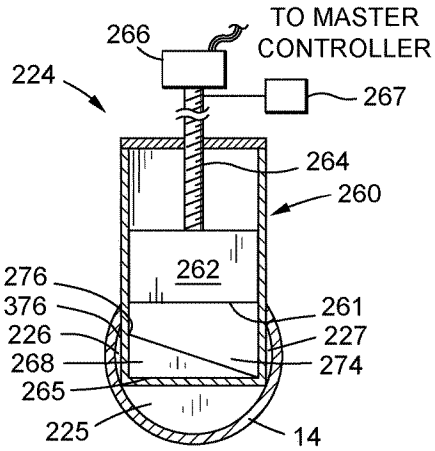
FIG. 3A
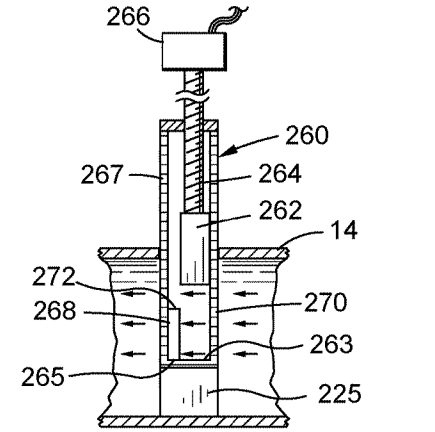
FIG. 3B
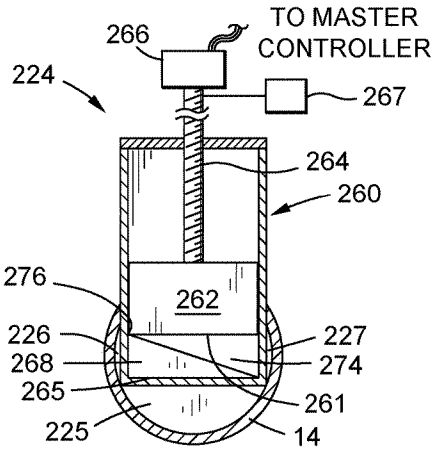
FIG. 4A
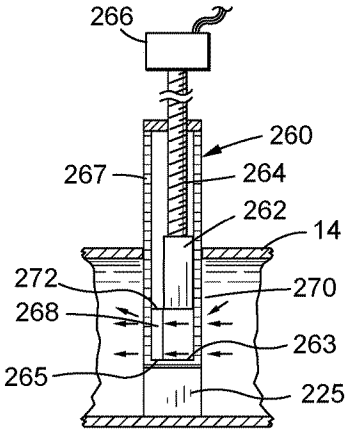
FIG. 4B
FIG. 5A
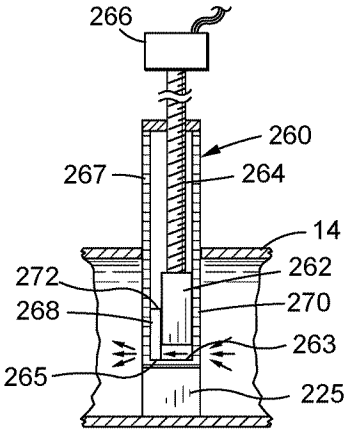
FIG. 5B

INTAKE PRESSURE CONTROL SYSTEM

CROSS-REFERENCE TO RELATED APPLICATIONS

This application claims priority from and is a continuation-in-part of U.S. patent application Ser. No. 16/030,634, filed Jul. 9, 2018, which is a continuation of U.S. patent application Ser. No. 15/433,734, filed Feb. 15, 2017. The disclosures of each of these applications are hereby incorporated in their entirety by reference herein.

TECHNICAL FIELD

This disclosure relates to pressure control systems, and more particularly, to an intake pressure control system for a mobile pumping apparatus such as a fire truck.

BACKGROUND

Over the years, various systems have been devised for controlling engine-driven fire pumps. For instance, U.S. Pat. Nos. 3,786,689 A and 4,189,005 A to McLoughlin, as well as U.S. Pat. No. 5,888,051 A to McLoughlin et al., disclose apparatus and methods for controlling the pressure output from engine-driven centrifugal fire pumps. U.S. Pat. No. 7,040,868 B2 to McLoughlin et al. discloses systems for controlling pumping speed during discharge pressure fluctuations. U.S. Pat. No. 8,517,696 B2 to Mcloughlin et al. discloses a system for maintaining the fluid intake pressure of a pumping system above a preset value, while U.S. Patent Application Publication No. 2005/0061373 A1 to McLaughlin (sic) et al. discloses a system for maintaining the fluid intake pressure below a preset value.

One disadvantage of pump pressure governors that only control discharge pressure is that they are often unresponsive, or too slow to respond to, sudden pressure changes at the intake end of the system. Also, these types of governors are not able to reduce extremely high incoming pressures—for instance, pressures of 200 psi or higher—to a safe discharge pressure of approximately 100 psi. In addition, these types of pressure control systems do not include any backup mechanisms for controlling the discharge pressure if the pump governor should fail.

The system disclosed in aforementioned U.S. Pat. No. 8,517,696 B2 to McLoughlin et al., which maintains the intake pressure above a preset value, is more effective at responding to sudden pressure drops than systems which control discharge only, but it is not designed to control sudden pressure increases, or to control the discharge pressure if the pump governor fails. Conversely, the system disclosed in U.S Patent Application Publication No. 2005/0061373 A1 to McLaughlin (sic), which maintains the fluid intake pressure below a preset value, is not designed to respond to sudden pressure drops or for use with non-pressurized fluid sources.

In addition, the intake pressure control systems disclosed in both U.S. Pat. No. 8,517,696 B2 to McLoughlin et al. and U.S Patent Application Publication No. 2005/0061373 A1 to McLaughlin (sic) require the presence of a reserve tank (in addition to the onboard supply reservoir carried on a fire truck), wherein excess flow is diverted to the reserve tank when the intake pressure is too high, and/or liquid from the reserve tank is added to the flow in the intake conduit when the intake pressure is too low. The reserve tank and its associated piping add weight to the fire truck and increase the overall complexity of the system, making it time-consuming to set up and take down.

Accordingly, there exists a need for an intake pressure control system that can operate effectively under high flow, high pressure conditions, as well as low flow, low pressure conditions; can respond quickly to sudden pressure drops and increases regardless of whether the fluid source is pressurized or unpressurized; and do not require the presence of a reserve tank.

SUMMARY

A pump intake pressure control apparatus according to the present disclosure comprises a conduit joining a pump to a liquid source, a wide-range flow controller configured to control the flow of liquid through the conduit, pressure sensors configured to detect the pressure of the liquid in the conduit upstream and downstream of the flow controller, and an electronic master controller programmed to receive input from the pressure sensors and to actuate the flow controller to maintain the pressure downstream of the flow controller at or below a predetermined desired value.

The pressure sensors comprise a first pressure sensor upstream of the flow controller and a second pressure sensor downstream of the flow controller. In a first embodiment, the flow controller divides the flow into two branches, with a valve located in each branch. The branches, one of which may be larger in diameter than the other, diverge from one another at a bifurcated inlet end downstream of the first pressure sensor, and converge toward one another at an outlet junction upstream of the second pressure sensor. The electronic master controller is programmed to actuate the first and second valves independently of one another.

In a second embodiment, the flow controller comprises a single wide-range valve. The wide-range valve may be in the form of a gate valve having a stationary triangular blocking member projecting into the passage between the inlet and outlet ports of the valve. When the gate is above the upper vertex of the triangular blocking member, the opening between the gate and the blocking member is trapezoidal and relatively large, allowing for a high flow rate, but as the gate travels past the upper vertex and towards the valve seat, the opening becomes triangular and gets progressively smaller, allowing for a much lower minimum flow rate than can be controlled by the conventional control valves that are currently utilized in the firefighting industry. When the opening is very small, it can cause suction downstream of the flow controller.

The flow controller may also include position indicators configured to indicate the positions of the valves, and the electronic master controller may be configured to receive input from the position indicators.

The pump intake pressure control apparatus may be part of a system including a liquid source, wherein the liquid source is a pressurized source such as a fire hydrant. Alternatively, the liquid source may be a non-pressurized source such as a pond. In the case of a non-pressurized source, the pressures upstream and downstream of the flow controller are negative.

The system may also include an additive tank containing an additive such as firefighting foam. The additive tank is coupled to the conduit at a location between the second pressure sensor and the pump, and a negative pressure at this location causes additive to be siphoned through the additive line into the conduit, where it mixes with the liquid.

BRIEF DESCRIPTION OF THE DRAWINGS

FIG. 3A is a simplified front view of a flow controller according to a second embodiment of the disclosure, with the gate in a fully raised position.

FIG. 3B is a simplified side view of FIG. 3A.

FIG. 4A is a simplified front view of the flow controller of FIG. 3A, with the gate in an intermediate position.

FIG. 4B is a simplified side view of FIG. 4A.

FIG. 5A is a simplified front view of the flow controller of FIG. 3A, with the gate in a nearly closed position.

FIG. 5B is a simplified side view of FIG. 5A.

DETAILED DESCRIPTION

Figure 1:
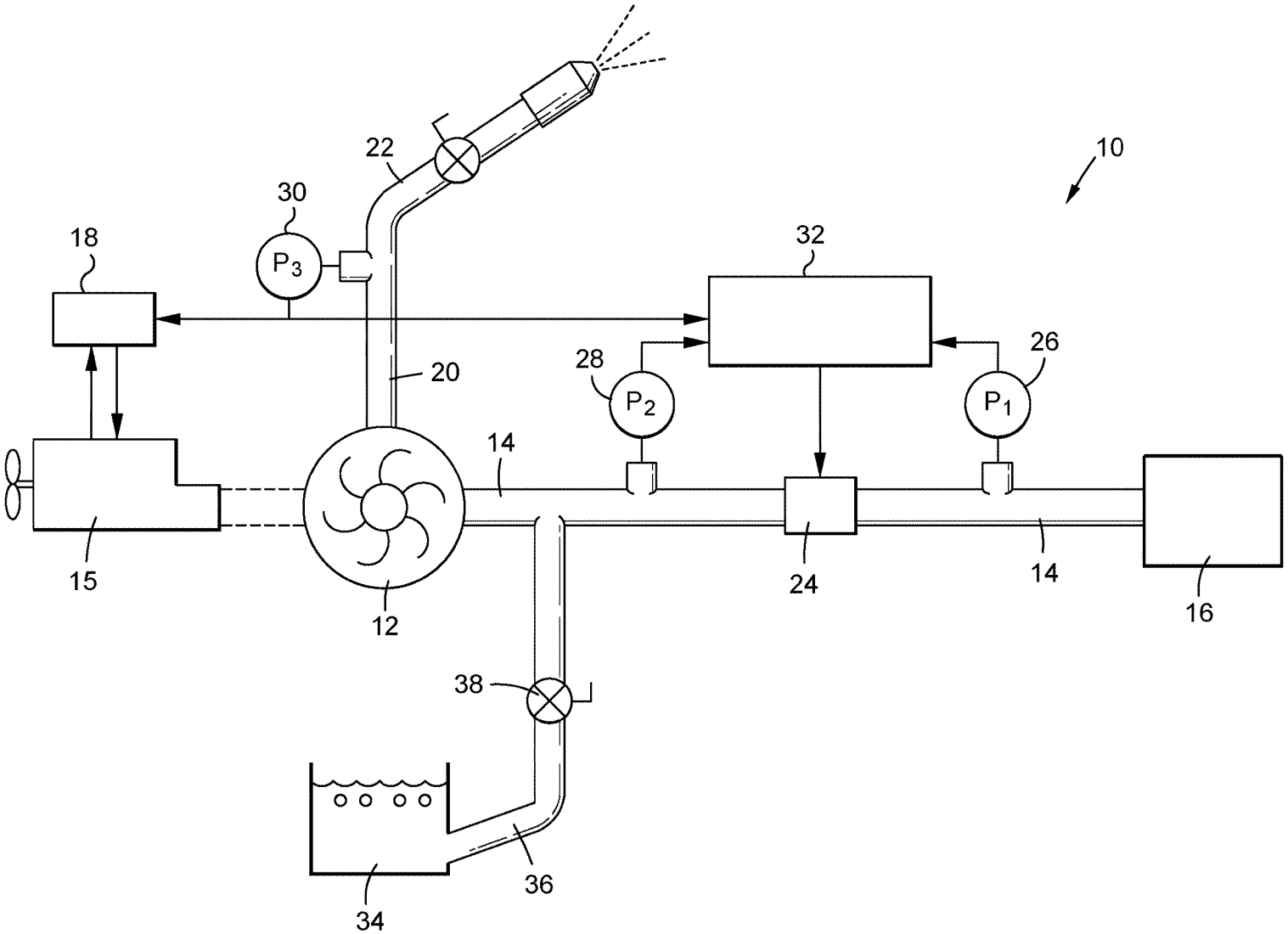
FIG. 1 is a schematic diagram of a pressure control system according to the present disclosure.

Turning now to the drawings, which are not necessarily to scale, and wherein some features may be exaggerated or minimized to show details of particular components, FIG. 1 shows a pressure control system according to the present disclosure, indicated in its entirety by the numeral 10. The system 10 includes a pump 12, for instance a centrifugal pump, connected by an intake conduit 14 to an inlet source 16 of a liquid such as water. The source 16 may be a pressurized source such as a fire hydrant, a static unpressurized source such as a lake or an onboard supply reservoir on a firetruck, or a dynamic unpressurized source such as a river.

The pump 12 is driven by an engine 15, the speed and other characteristics of which are controlled by a governor 18. The entire system 10, or parts of it, may be incorporated into a vehicle such as a fire truck. A discharge conduit 20 leading from the pump 12 is connected to at least one valved hose 22 or similar discharge line. A wide-range flow controller 24 is provided in the intake conduit 14 between the inlet source 16 and the pump 12. For the purposes of this disclosure, a wide-range flow controller is defined as a valve or combination of valves having sufficiently high rangeability to withstand high flow rates at high pressures (for instance, approximately 200 psi or higher at approximately 1000 gallons per minute or higher), such as when the system is connected to a fire hydrant, while also being able to accurately control liquids flowing at relatively low flow rates and low pressures, such as when the system is connected to a static, unpressurized fluid source.

A first pressure sensor 26 is provided in or on an upstream section of the intake conduit 14 between the inlet source 16 and the flow controller 24, and a second pressure sensor 28 is provided in or on a downstream section of the intake conduit 14 between the flow controller 24 and the pump 12. A third pressure sensor 30 is provided in or on the discharge conduit 20. The wide-range flow controller 24 and pressure sensors 26, 28, and 30 are electronically coupled to an electronic master controller 32 such as a computer or microprocessor.

An additive tank 34 containing firefighting foam or other additives may be coupled to the system 10 via an additive conduit 36 that joins the intake conduit 14 between the wide-range flow controller 24 and the pump 12. When an additive valve 38 in the additive conduit 36 is open and the pressure at the intake end of the pump 12 is negative (preferably about −10 psi), the foam or other additives are siphoned out of the additive tank 34. The additive valve 38 is preferably a calibrated valve allowing an operator to control the amount of additive entering in proportion to the liquid. For instance, an amount of foam equal to about 3 to 6% of the total mixture could be added. The calibrated valve 38 could be operated either manually or electronically.

Figure 2:
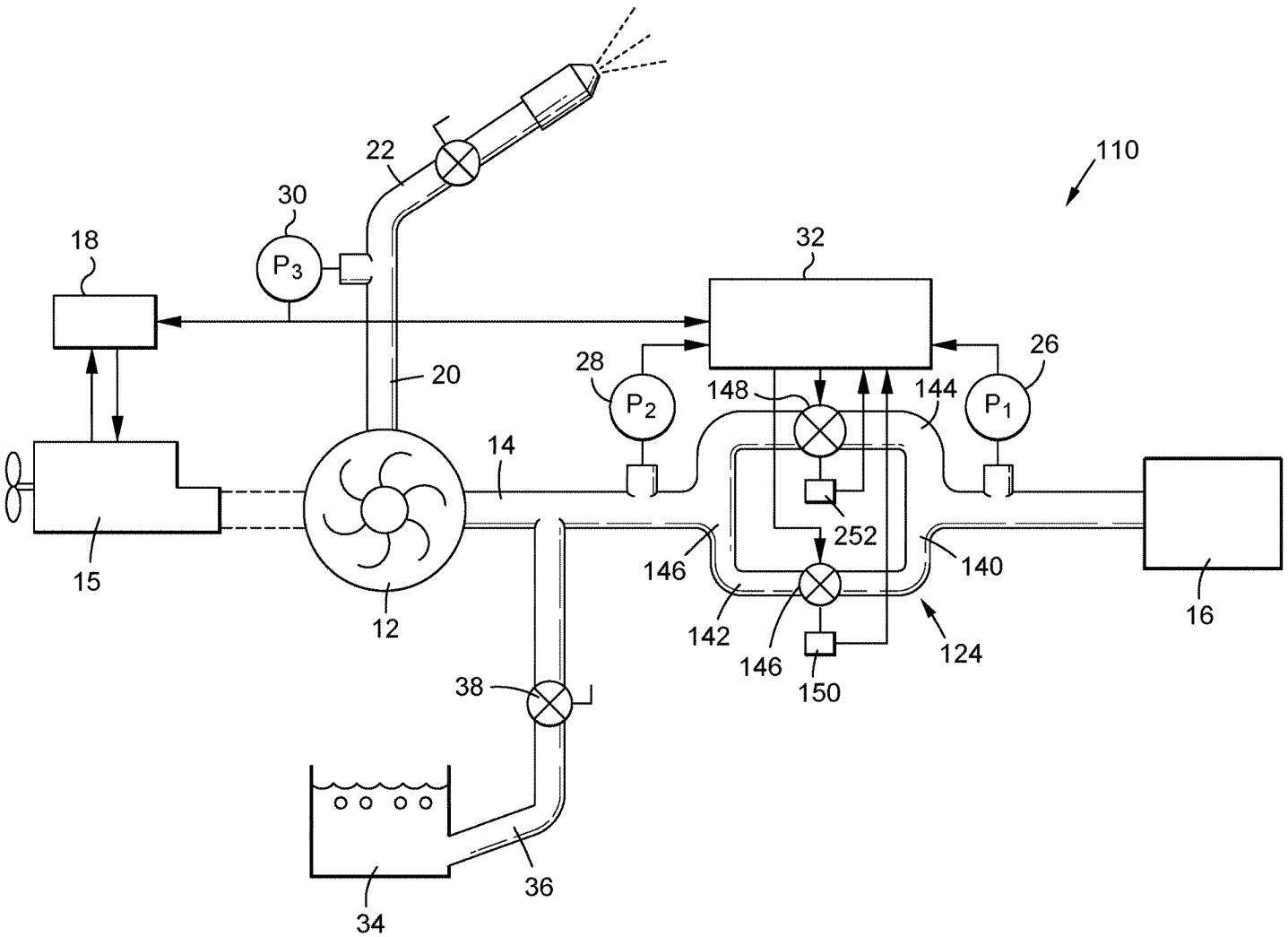
FIG. 2 is a schematic diagram showing the pressure control system of FIG. 1, with a flow controller according to a first embodiment of the disclosure.

FIG. 2 shows a pressure control system 110 having a wide-range flow controller 124 according to a first embodiment of the disclosure. The wide-range flow controller 124 includes a bifurcated inlet end 140 that divides the intake conduit 14 into a first branch 142 and a second branch 144. The second branch 144 preferably has a larger cross-sectional area than the first branch 142. The two branches 142, 144 converge at an outlet junction 146.

A first valve 146 in the first branch 142 controls the flow of liquid through the first branch 142, and a second valve 148 in the second branch 144 controls the flow of liquid through the second branch 144. The first valve 146 is coupled to a first position indicator 150, and the second valve 148 is coupled to a second position indicator 252. The valves 146, 148 may be servo driven or, alternatively, could be driven hydraulically, pneumatically, or by water pressure from the pump.

In a typical application, the first valve 146 may initially be open, and the second valve may initially be closed. Both valves are programmed not to change states unless the third pressure sensor 30 detects that there is discharge from the pump 12, since there is no need to regulate pressure if there is no discharge. Once discharge from the pump 12 is detected, the master controller 32 monitors the pressures p1, p2 at first and second pressure sensors 26, 28, respectively, and varies the position of the first valve 146 as needed to keep the pressure p2 at the second pressure sensor 28 at or below a predetermined desired value $P_D$. If a negative $P_D$ is required, it can be achieved by keeping the second valve 148 closed and creating a very small orifice with the first valve 146.

If the pressure sensors detect that the flow rate through the wide-range flow controller 124 is too great to be effectively regulated by the first valve 146 alone, the master controller 32 opens the second valve 148, and adjusts its position as needed to maintain p2 at or below $P_D$. At the same time, the governor 18 regulates the speed of the engine 14 to control the discharge pressure p3 as measured by the third pressure sensor 30.

In one firefighting scenario, for instance when using a fire hydrant at the bottom of a hill in a hilly area, the incoming pressure p1 may be 200 psi high or higher. If no additive is needed in this scenario, the desired pressure is set to a safe value such as 50 psi, and the master controller 32 adjusts the positions of first and second valves 146, 148 as needed to maintain p2 below this value. The governor 18 then increases the engine rpm as needed to raise p3 back to a pressure high enough to effectively extinguish the fire, but low enough to remain safe for the firefighters (typically about 100 psi). If for any reason governor 18 fails, resulting in too high a discharge pressure p3, the master controller 46 can manipulate the first and second valves 146, 148 to provide some regulation of p3.

In scenarios where an additive is required and/or when drawing water from an unpressurized source such as a pond, lake, or onboard water tank, the system operates in a similar fashion, except that the desired pressure is set to a negative value such as −10 psi in order to maintain sufficient suction to draw liquid from the unpressurized source and/or the additive tank. In such scenarios, the governor 18 must increase the engine rpm to a higher rate than in the previous scenario in order to achieve the desired final discharge pressure p3 of about 100 psi.

A wide-range flow controller 224 according to a second embodiment of the disclosure is shown in FIGS. 3A-B, 4A-B, and 5A-B. The wide-range flow controller 224 comprises a valve housing 260 that is positioned within the intake conduit 14 by a plurality of mounting blocks 225, 226, 227, which prevent flow between the housing 260 and the conduit 14. A rectangular gate 262 is carried at the distal end of a stem 264 that is mounted for reciprocation towards and away from a valve seat 263 formed at the distal end of the valve housing 260. Reciprocation of the stem 264 is controlled by a servo or other motor 266 controlled by the master controller. A position indicator or sensor 267 may be coupled to the stem 262 or elsewhere to give visual or digital indication of the position of the gate 262.

A stationary triangular wedge or blocking member 268 is disposed in the distal end of the housing 260 between the inlet port 270 and the outlet port 272, and just upstream or downstream of the gate 262. The blocking member 268 has a base 265 that extends parallel to the valve seat 263 and an upper vertex 276 that abuts a side wall 267 of the valve housing 260. The function of the blocking member 268 is to reduce the size of the flow passage 274 between the distal surface 261 of the gate 262 and the valve seat 263 relative to the flow passage of a similarly dimensioned, unobstructed gate valve. When the flow controller 224 is in an almost-closed position, as shown in FIGS. 5A and B, the flow passage 274 is triangular in cross-section, and is very small, thus allowing for a very small minimum controllable flow.

As the gate 262 moves away from the valve seat 263 to the position shown in FIGS. 4A and B, the triangular flow passage 274 gets progressively larger until it passes the upper vertex 276 of the triangular blocking member 268. At that point, the flow passage 274 becomes trapezoidal in cross-section and increases in size at a faster rate, until the gate 262 reaches its highest position, as shown in FIGS. 3A and B, corresponding to a fully open position of the flow controller 224, and accommodating the maximum allowable flow.

Like the wide-range flow controller 124 shown in FIG. 2, the wide-range flow controller 224 of FIGS. 3A-B, 4A-B, and 5A-B can be used with a flow control system 10 having either a pressurized source or an unpressurized source. As in the previous embodiment, the flow controller 224 is initially open, and does not change states until the third sensor detects discharge from the pump and the first and second sensors detect either a) an unacceptable deviation from the desired pressure $P_D$ at the second pressure sensor or b) a sudden drastic change at the first pressure sensor (such as might be experienced, first instance, when a fire engine runs over the hose connecting the fluid source to the system.) If the pump is discharging and the system detects that the pressure at the second pressure sensor is below a desired value or that the source pressure has dropped too far below its initial value, the flow controller motor 266 is actuated to move the stem 264 and gate 262 further away from the valve seat 263, increasing the rate at which liquid flows through the inlet conduit 14. Conversely, if the pump is discharging and the system detects that the pressure at the second pressure sensor is above the desired value or that the source pressure has surged too far above its initial value, the flow controller motor 266 is actuated to move the stem 264 and gate 262 closer to the valve seat 263, decreasing the rate at which liquid flows through the inlet conduit 14.

The gate 264 continues to move until the pressure sensors 26, 28, and 30 detect that optimum pressure conditions have been met. At that point, movement of the gate 264 is halted, resuming only occasionally when adjustments in pressure are required. For low flow conditions, such as, for instance, when liquid is being supplied by an unpressurized source and/or when suction is required to draw from an additive tank situated between the flow controller and the pump, the gate 264 will typically be positioned below the upper apex of the triangular blocking member 268. For high flow conditions, such as, for instance, when no additive is required and liquid is being supplied by a fire hydrant or other pressurized source, the gate 264 will typically be positioned above the upper apex 276 of the blocking member.

A software control algorithm and program for operating the wide-range flow controller 224 of the second embodiment is described with reference to FIG. 6. Initially, the valve 224 is open as shown at Statement A. At Statement B, the desired pressure for $P_2$ ($P_D$) is read. For applications in which the source 16 is pressurized and no additive is required, $P_D$ will have been preset to a positive safe value such as 50 psi. For applications in which additive is required and/or the source 16 is not pressurized, $P_D$ will have been preset to a negative value such as −10 psi.

At Statement C, the pressure $p_3$ at the third pressure sensor 30 is read. Decision D is a step for determining whether there is discharge from the pump (ie. is $p_3$>0?). If there is no discharge from the pump, the flow controller 224 is not activated, since there is no need to regulate pressure if there is no discharge. If there is discharge from the pump, the pressures $p_1$ and $p_2$ at the first and second pressure sensors are read, as shown at Statements E and F, and the system continues to Statement G. If there is no discharge from the pump, the system cycles back to Statement C.

At statement G, the difference $E_2$ between the actual pressure $p_2$ at the second pressure sensor and the desired pressure $P_D$ is calculated. If, at Decision H, $E_2$ is determined to be within an acceptable range, the system skips ahead to Statements L-S, which will be described below. If $E_2$ is determined not to be within the acceptable range, the system moves on to Decision I, where it determines whether $E_2$ is negative or positive. If $E_2$ is negative, meaning that $p_2$ is too low relative to the desired pressure $P_D$, the gate 262 of the valve 224 moves upwardly, increasing the size of the flow aperture 274, as indicated at statement J. If $E_2$ is positive, meaning that $p_2$ is too high relative to the desired pressure $P_D$, the gate 262 of the valve 224 moves downwardly, decreasing the size of the flow aperture 274, as indicated at Statement K. The system then cycles back to Statement F and repeats itself until the pressure $p_2$ is within the desired range of $P_D$ at which point the system moves on to Statement L.

At Statement L, the valve remains at its current position. At Statement M, the pressure $p_1$ at the first pressure sensor is read. I. At Statement N, the difference $E_1$ between the current $p_1$ and the initial $p_1$ (ie. the value that was read at Statement E) is calculated. If, at Decision O, $E_1$ is determined to be within preset threshold limits (ie. the pressure at the source has not significantly changed from its initial value), the valve is maintained at the current position, as shown at Statement P, and the system cycles back to Statement F. If $E_1$ is determined not to be within the threshold limits (ie. the pressure at the source has significantly changed), the system moves on to Decision Q, where it determines whether the change in pressure at the source is positive or negative. If the change is positive (ie. the pressure has significantly increased above its initial value), gate 262 of the valve 224 moves downwardly, decreasing the size of the flow aperture 274, as shown at Statement R, and the system cycles back to Statement F. If the change is negative (ie. the pressure has significantly dropped below its initial value), the gate 262 of the valve 224 moves upwardly, increasing the size of the flow aperture 274, as shown at Statement S, and the system cycles back to Statement F.

Figure 6:
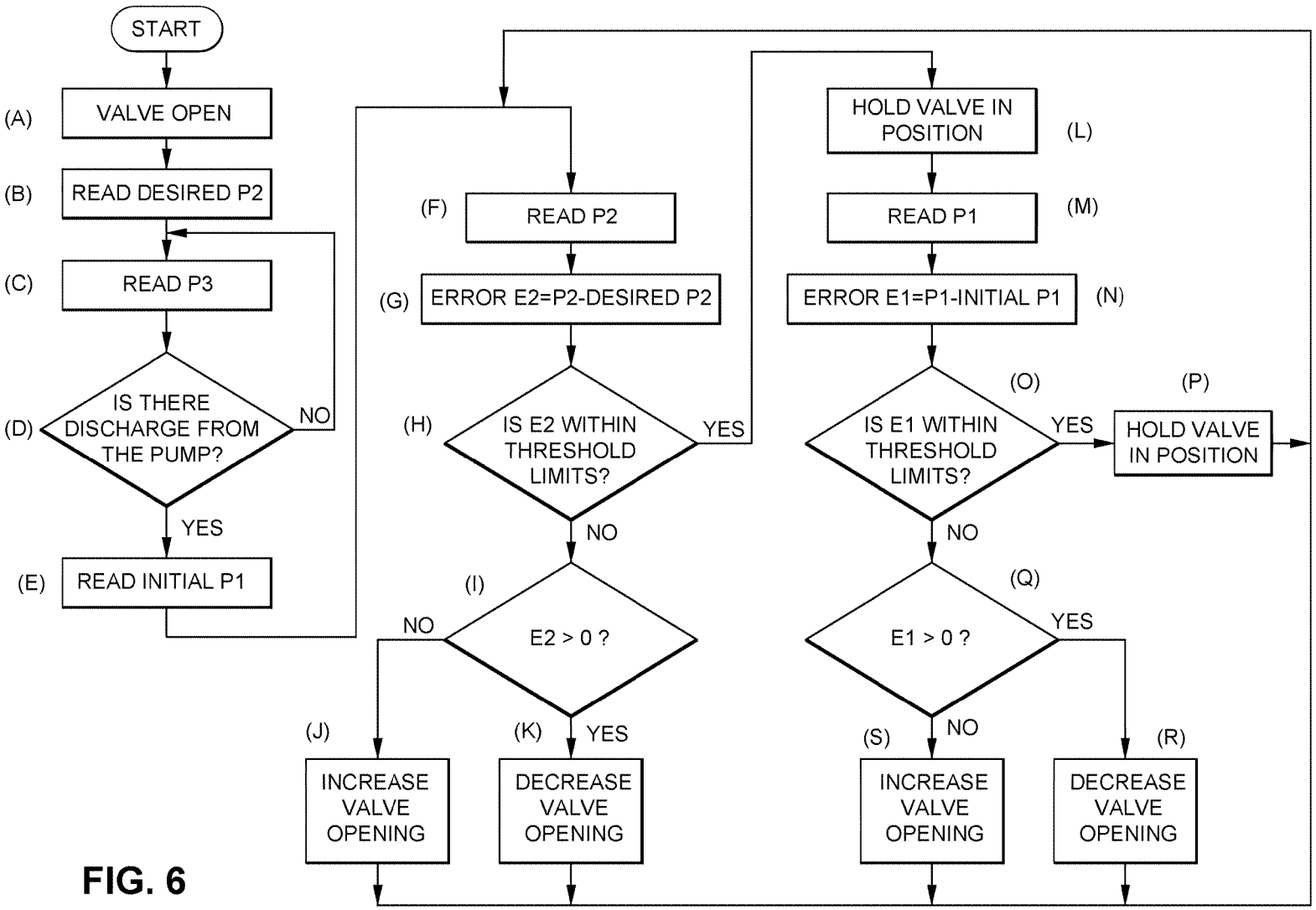
FIG. 6 is a simplified flow diagram depicting the digital logic of the intake pressure control system of the present disclosure.

The control algorithm for operating a wide-range low controller 124 of the type shown in FIG. 2 is similar to the algorithm illustrated in FIG. 6, but is more complex due to the fact that the system controls two valves 146, 148, rather than one.

While the principles of the invention have now been made clear in the illustrated embodiment, there may be immediately obvious to those skilled in the art many modifications of structure, arrangements, proportions, elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What is claimed is:

1. An intake pressure control system for controlling the flow of fluids into a pump, comprising:

a liquid source;

an intake conduit conducting liquid from the liquid source to the pump;

a wide-range flow controller located in the intake conduit and configured to control the flow of the liquid through the intake conduit, wherein the wide-range flow controller includes a valve housing having a distal end, a valve seat formed in the distal end of the valve housing, a gate mounted for reciprocation within the valve housing, the gate having a distal surface, a triangular blocking member supported in the distal end of the valve housing, the triangular blocking member having a base extending parallel to the valve seat and an upper vertex abutting a side wall of the valve housing, and an actuator configured to move the gate from a fully closed position against the valve seat to a fully open position above the upper vertex of the triangular member, wherein the gate, the triangular blocking member, and the valve housing define a triangular flow passage allowing flow to pass through the flow controller at a low flow rate when the distal surface of the gate is positioned between the valve seat and the upper vertex of the triangular blocking member, and wherein the gate, the triangular blocking member, and the valve housing define a trapezoidal flow passage allowing flow to pass through the flow controller at a high flow rate when the distal surface of the gate is positioned above the upper vertex of the triangular blocking member;

a first pressure sensor located between the liquid source and the wide-range flow controller, and configured to detect the pressure of liquid in the conduit upstream of the wide-range flow controller;

a second pressure sensor located between the wide-range flow controller and the pump and configured to detect the pressure of the liquid in the intake conduit downstream of the wide-range flow controller; and an electronic master controller programmed to receive input from the first and second pressure sensors and to operate the wide-range flow controller to maintain the pressure at the second pressure sensor at or below a predetermined desired value.

2. The intake pressure control system according to claim 1, wherein:

the electronic master controller is programmed to change the position of the gate when the second pressure sensor detects that the pressure of the liquid in the intake conduit downstream of the wide-range flow controller falls outside of an acceptable range away from the predetermined desired value.

3. The intake pressure control system according to claim 2, wherein the electronic master controller is further programmed to:

compare a current pressure detected by the first pressure sensor to an initial pressure detected by the first pressure sensor; and change the position of the gate when the first pressure sensor detects that the current pressure detected by the first pressure sensor falls outside of an acceptable range away from the initial pressure detected by the first pressure sensor.

4. The intake pressure control system according to claim 2, wherein the electronic master controller is connected to a third pressure sensor located downstream of the pump and programmed to change the position of the gate only when the third pressure sensor detects discharge from the pump.

5. The intake pressure control system according to claim 1, wherein the electronic master controller is programmed to maintain the pressure at the second pressure sensor at or below the predetermined desired value without diverting excess flow to a reserve tank.

6. The intake pressure control system according to claim 1, wherein the liquid source is unpressurized.

7. The intake pressure control system according to claim 1, wherein the predetermined desired value is 50 psi or less.

8. The intake pressure control system according to claim 3, wherein the liquid source is pressurized.

9. The intake pressure control system according to claim 8, wherein the predetermined desired value is negative.

10. An intake pressure control system for controlling the flow of fluids into a pump, comprising:

a liquid source;

an intake conduit conducting liquid from the liquid source to the pump;

a wide-range flow controller located in the intake conduit and configured to control the flow of the liquid through the intake conduit;

a first pressure sensor located between the liquid source and the wide-range flow controller, and configured to detect the pressure of liquid in the conduit upstream of the wide-range flow controller;

a second pressure sensor located between the wide-range flow controller and the pump and configured to detect the pressure of the liquid in the intake conduit downstream of the wide-range flow controller; and an electronic master controller programmed to continuously receive pressure readings from the second pressure sensor, receive and store an initial pressure reading from the first pressure sensor;

calculate the difference $E_2$ between a current pressure reading $P_2$ from the second pressure sensor and a predetermined desired pressure $P_D$, determine whether $E_2$ falls within a first set of predetermined threshold limits, operate the wide range flow controller to increase flow through the intake conduit if $E_2$ falls outside of the first set of predetermined threshold limits and is negative, operate the wide range flow controller to decrease flow through the intake conduit if $E_2$ falls outside of the predetermined threshold limits and is positive, maintain the wide range flow controller in its current state and receive a current pressure reading $P_1$ from the first pressure sensor if $E_2$ falls within the first set of predetermined threshold limits, compare the current pressure $P_1$ to the stored initial reading from the first pressure sensor, calculate the difference $E_1$ between $P_1$ and the stored initial reading from the first pressure sensor, determine whether $E_1$ falls within a second set of predetermined threshold limits, continue to maintain the wide range flow controller in its current state if $E_1$ falls within the second set of predetermined pressure limits, operate the wide range flow controller to increase flow through the intake conduit if $E_1$ falls outside of the first set of predetermined threshold limits and is positive, operate the wide range flow controller to decrease flow through the intake conduit if $E_2$ falls outside of the predetermined threshold limits and is negative.

11. An intake pressure control system for controlling the flow of fluids into a pump, comprising:

a pressurized liquid source;

an intake conduit conducting liquid from the liquid source to the pump;

a wide-range flow controller located in the intake conduit and configured to control the flow of the liquid through the intake conduit, the wide-range flow controller including a valve that is moveable between a fully open position and a fully closed position;

a first pressure sensor located between the liquid source and the wide-range flow controller, and configured to detect the pressure of liquid in the conduit upstream of the wide-range flow controller;

a second pressure sensor located between the wide-range flow controller and the pump and configured to detect the pressure of the liquid in the intake conduit downstream of the wide-range flow controller; and an electronic master controller programmed to receive input from the first and second pressure sensors and to actuate the wide-range flow controller to reduce flow through the conduit when the second pressure sensor detects that the pressure of the liquid in the conduit downstream of the wide-range flow controller exceeds a predetermined negative value.

12. The intake pressure control system according to claim 11, wherein:

the wide-range flow controller comprises a valve that is moveable between a fully open position and a fully closed position; and the electronic master controller is programmed to change the position of the valve when the second pressure sensor detects that the pressure of the liquid in the intake conduit downstream of the valve falls outside of an acceptable range away from the predetermined negative value.

13. The intake pressure control system according to claim 11, wherein the predetermined negative value is sufficient to siphon liquid from an additive tank.

14. The intake pressure control system according to claim 12, wherein the predetermined negative value is about −10 psi.

* * * * *